US006667283B2

(12) United States Patent
Kravitz et al.

(10) Patent No.: US 6,667,283 B2
(45) **Date of Patent: *Dec. 23, 2003**

(54) ANTIMICROBIAL, HIGH LOAD BEARING CONVEYOR LUBRICANT

(75) Inventors: Joseph I. Kravitz, Champlin, MN (US); Joy G. Herdt, New Port, MN (US); Kimberly L. Person Hei, Baldwin, WI (US); Michael E. Besse, Golden Valley, MN (US)

(73) Assignee: Ecolab Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/231,255

(22) Filed: Jan. 15, 1999

(65) Prior Publication Data

US 2002/0006881 A1 Jan. 17, 2002

(51) Int. Cl.[7] ..... C10M 141/10
(52) U.S. Cl. ..... 508/438; 508/547; 508/577
(58) Field of Search ..... 508/577, 438, 508/501, 547

(56) References Cited

U.S. PATENT DOCUMENTS

| | | | | |
|---|---|---|---|---|
| 2,779,740 A | 1/1957 | Messina et al. | ..... | 252/51.5 |
| 3,382,032 A | 5/1968 | Cox | ..... | 21/60.5 |
| 3,645,897 A | 2/1972 | Glower et al. | ..... | 252/34.7 |
| 3,718,588 A | 2/1973 | Bellos et al. | ..... | 252/32.5 |
| 3,860,521 A | 1/1975 | Aepli et al. | ..... | 252/34.7 |
| 4,384,965 A | 5/1983 | Hellsten et al. | ..... | 252/32.5 |

(List continued on next page.)

FOREIGN PATENT DOCUMENTS

| | | | | |
|---|---|---|---|---|
| FR | 0533552 | | 3/1993 | ..... C10M/133/08 |
| JP | 2097592 | | 2/1992 | ..... C10M/105/00 |
| JP | 2097593 | | 2/1992 | ..... C10M/105/00 |
| JP | 07 34079 | | 2/1995 | ..... C10M/105/00 |
| JP | 08333592 | | 12/1996 | ..... C10M/105/00 |
| WO | WO 95/34694 | | 12/1995 | |
| WO | 96/02616 | * | 2/1996 | |
| WO | 97/20903 | * | 6/1997 | |

OTHER PUBLICATIONS

"Anionics GAFAC Surfactants", *Rhone–Poulenc Catalog of Surfactants & Specialties*, 5–7, (1993).

"Carbonated Beverages", *Encyclopedia of Chemical Technology, 5,* 4th Edition, John Wiley & Sons Pub., 26–27, No date.

"EMPHOS Organic Phosphate Esters", *Witco Chemical: Organics Division, Bulletin234*, Witco Chemical: Organics Division, 1,2,4,6,8, (Nov. 1977).

*Primary Examiner*—Cephia D. Toomer
(74) *Attorney, Agent, or Firm*—Merchant & Gould P.C.

(57) ABSTRACT

Lubricating solutions are used on conveying systems in the beverage industry during the filling of containers with dairy products or other beverages. Lubricating compositions of the present invention, especially those designed for use in heavy load bearing conveyors such as those in the dairy industry conveying systems for contained beverages, comprise at least the following components:

a) an alkyl alkoxylated (e.g., ethoxylated or propoxylated, preferably ethoxylated) phosphate ester, b) a secondary alcohol alkoxylate, (with an optional aryl [e.g., aromatic, such as phenol] alkoxylated [e.g., ethoxylated or propoxylated] phosphate ester), c) an aromatic or linear quaternary ammonium antimicrobial agent, and d) a liquid carrier, such as water.

These lubricating solutions are capable of providing good lubricity and antimicrobial activity over a prolonged time and under high stress and heavy loads.

44 Claims, 4 Drawing Sheets

U.S. PATENT DOCUMENTS 4,419,253 A 12/1983 Kennedy et al. ..... 252/34.7
4,521,321 A 6/1985 Anderson et al. ..... 252/49.3
4,557,848 A 12/1985 Sung et al. ..... 252/51.5 R
4,604,220 A 8/1986 Stanton ..... 252/33.4
4,624,793 A 11/1986 Phifer et al.
4,636,321 A 1/1987 Kipp et al. ..... 508/431
4,758,359 A 7/1988 Kirk et al. ..... 508/174
4,839,067 A 6/1989 Jansen ..... 252/11
5,062,979 A 11/1991 Scharf et al. ..... 252/49.3
5,073,280 A 12/1991 Rossio et al. ..... 252/49.3
5,182,035 A 1/1993 Schmidt et al. ..... 252/34
5,190,679 A 3/1993 McDonald ..... 252/41
5,223,162 A 6/1993 Rossio ..... 252/33.2
5,244,589 A * 9/1993 Liu et al. ..... 508/547
5,282,992 A 2/1994 Reichgott ..... 252/51.5 R
5,352,376 A 10/1994 Gutzmann ..... 252/49.3
5,391,308 A 2/1995 Despo ..... 252/32.5
5,407,700 A 4/1995 Man et al. ..... 427/154
5,409,713 A 4/1995 Lokkesmoe et al. ..... 424/616
5,419,908 A 5/1995 Richter et al. ..... 424/405
5,436,008 A 7/1995 Richter et al. ..... 424/405
5,437,868 A 8/1995 Oakes et al. ..... 424/405
5,441,654 A 8/1995 Rossio ..... 252/49.3
5,462,681 A 10/1995 Gutzmann et al. ..... 252/11
5,489,434 A 2/1996 Oakes et al. ..... 424/405
5,510,045 A 4/1996 Remus ..... 252/49.3
5,667,349 A 9/1997 Turchin et al. ..... 508/174
5,723,418 A * 3/1998 Person Hei et al. ..... 508/511

* cited by examiner

ANTIMICROBIAL, HIGH LOAD BEARING CONVEYOR LUBRICANT

BACKGROUND OF THE INVENTION

1. Field of the Invention

The present invention relates to lubricants, especially antimicrobial lubricants, and most especially to antimicrobial lubricants for use in conveyor systems for dairy containers, and especially for use with high load bearing conveyors.

2. Background of the Art

In the commercial distribution of most beverages, the beverages are packaged in containers of varying sizes, such containers being in the form of cartons, cans, bottles, tetrapack packages, waxed carton packs, and other forms of containers. In most packaging operations, the containers are moved along conveying systems, usually in an upright position (with the opening of the container facing vertically up or down), and moved from station to station, where various operations are performed (e.g., filling, capping, labeling, sealing, etc.). The containers, in addition to their many possible formats and constructions, may comprise many different types of materials, such as metals, glasses, ceramics, papers, treated papers, waxed papers, composites, layered structures, and polymeric materials (e.g., especially polyolefins such as polyethylene, polypropylene, polystyrene and blends thereof, polyesters such as polyethyleneterephthalate and polyethylenenaphthalate and blends thereof, polyamides, polycarbonates, etc.).

There are a number of different requirements which are essential or desirable for antimicrobial lubricants in the conveying systems used to carry containers for beverages. The essential requirements are that the material provide an acceptable level of lubricity for the system and that the lubricant displays an acceptable antimicrobial activity. It is also desirable that the lubricant have a viscosity which allows it to be applied by conventional pumping and/or application apparatus (e.g., spraying, roller coating, wet bed coating, etc.) as commonly used in the beverage conveyor lubricating art, and that the lubricant is beverage compatible so that it does not form solid deposits when it accidentally contacts spilled beverage on the conveyor system. This last requirement can be especially important since the formation of deposits on the conveyor will change the lubricity of the system and could require shut-down of the equipment to facilitate cleaning. Deposits may occur from the combination of beverage and lubricant in a number of different chemical methods, depending upon the particular beverage and lubricant used. One of the more common forms of deposit is caused by the formation of micelles from the interaction of species, especially different ionic species within the two materials.

Different types of lubricants have been used in the beverage conveying industry with varying degrees of success. A more common type of lubricant is the fatty acid lubricant (either the acid itself or amine salt and/or ester derivatives thereof), some of which are described in U.S. Pat. No. 5,391,308. Another type of lubricant used within this field is the organic phosphate ester, as shown in U.S. Pat. No. 4,521,321 and PCT Application WO 96/02616, based upon British Patent Application 94/14442.5 filed Jul. 18, 1994 (PCT/GB95/01641).

U.S. Pat. No. 5,391,308 discloses phosphate esters other than alkyl or linear esters (e.g., the alkyl aryl phosphate esters described on column 6, lines 11–20 used in combination with the alkyl or linear phosphate esters). The lubricant system of this patent also requires the use of an aqueous based long chain fatty acid composition at a pH of from 9.0 to 10.5 as the lubricant, with specifically combined ingredients to avoid stress cracking in polyethylene terephthalate (PET) bottles transported on a conveyor system. The aromatic-polyoxyalkyl esters are specifically disclosed as part of a combination of esters (along with the alkyl esters) which > ". . . results in substantial reduction in stress cracking, thus functioning as the stress cracking inhibiting agent, as well as the emulsifying agent, in the aqueous lubricant concentrate.@ (Column 3, lines 48–52)."

The reference is specific to fatty acid lubricants, and the specification points out that the use of potassium hydroxide as the saponifying agent, in fatty acid lubricants, has been found to contribute to and to promote stress cracking in P.E.T. (polyethylene terephthalate) bottles. A blend of alkyl phosphate esters and aromatic phosphate esters are shown in combination with the fatty acid lubricant to reduce stress cracking.

PCT Application WO 96/02616 describes the use of lubricant concentrates comprising organic alkyl phosphate esters, aromatic biocidal quaternary ammonium compounds, and sufficient base to provide the concentrate with a pH of from 5 to 10.

U.S. Pat. No. 4,521,321 describes lubricants for conveyor systems which comprise dilute aqueous systems of partially neutralized monophosphate aliphatic (e.g., saturated or partially unsaturated linear alkyl). The use of a synergist such as long chain fatty alcohol, fatty acid derived amine oxide, or urea improves the properties of the lubricant.

U.S. Pat. No. 5,062,979 describes lubricants for conveyor systems comprising aqueous, clear solution-forming, substantially soap-free compositions. These lubricants comprise pH 6–8 compositions comprising alkyl benzene sulfonates, partial phosphate esters with alkoxylated aliphatic alcohols, and aliphatic carboxylic acids. Typical additives such as solubilizers, solvents, foam inhibitors and disinfectants may also be present. The aliphatic carboxylic acids are C6–C12 fatty acids.

U.S. patent application Ser. No. 09/002796, titled "ANTIMICROBIAL, BEVERAGE COMPATIBLE" and filed on Jan. 5, 1998, now abandoned describes Lubricating compositions of the invention, especially those designed for use in beverage conveying systems for contained beverages, comprise at least the following components:

a) an alkyl alkoxylated (e.g., ethoxylated or propoxylated, preferably ethoxylated) phosphate ester, b) aryl (e.g., aromatic, such as phenol) alkoxylated (e.g., ethoxylated or propoxylated) phosphate ester, c) an aromatic or linear quaternary ammonium antimicrobial agent, and d) a liquid carrier, such as water.

Particularly desirable optional agents with high degrees of utility include chelating agents (e.g., the aminoacetic acid chelating agents such as ethylene diamine tetraacetic acid, EDTA), detergents (e.g., nonionic surfactants) and pH control agents, e.g, potassium or sodium hydroxide.

SUMMARY OF THE INVENTION

Lubricating compositions of the invention, especially those designed for use in dairy product conveying systems, particularly those with high load-bearing requirements, comprise at least the following components:

a) an alkyl alkoxylated (e.g., ethoxylated or propoxylated, preferably ethoxylated) phosphate ester, b) a viscosity control agent selected from the group consisting of i) secondary alcohol alkoxylates, especially secondary alcohol ethoxylates and ii) a mixture of at least one secondary alcohol alkoxylate and at least one aryl (e.g., aromatic, such as phenol) alkoxylated (e.g., ethoxylated or propoxylated) phosphate ester, c) an aromatic or linear quaternary ammonium antimicrobial agent or mixtures thereof, and d) a liquid carrier, such as water.

Particularly desirable optional agents with high degrees of utility include chelating agents (e.g., the aminoacetic acid chelating agents such as ethylene diamine tetraacetic acid, EDTA), detergents (e.g., nonionic surfactants) and pH control agents, e.g, potassium or sodium hydroxide.

DETAILED DESCRIPTION OF THE INVENTION

Figure 1:
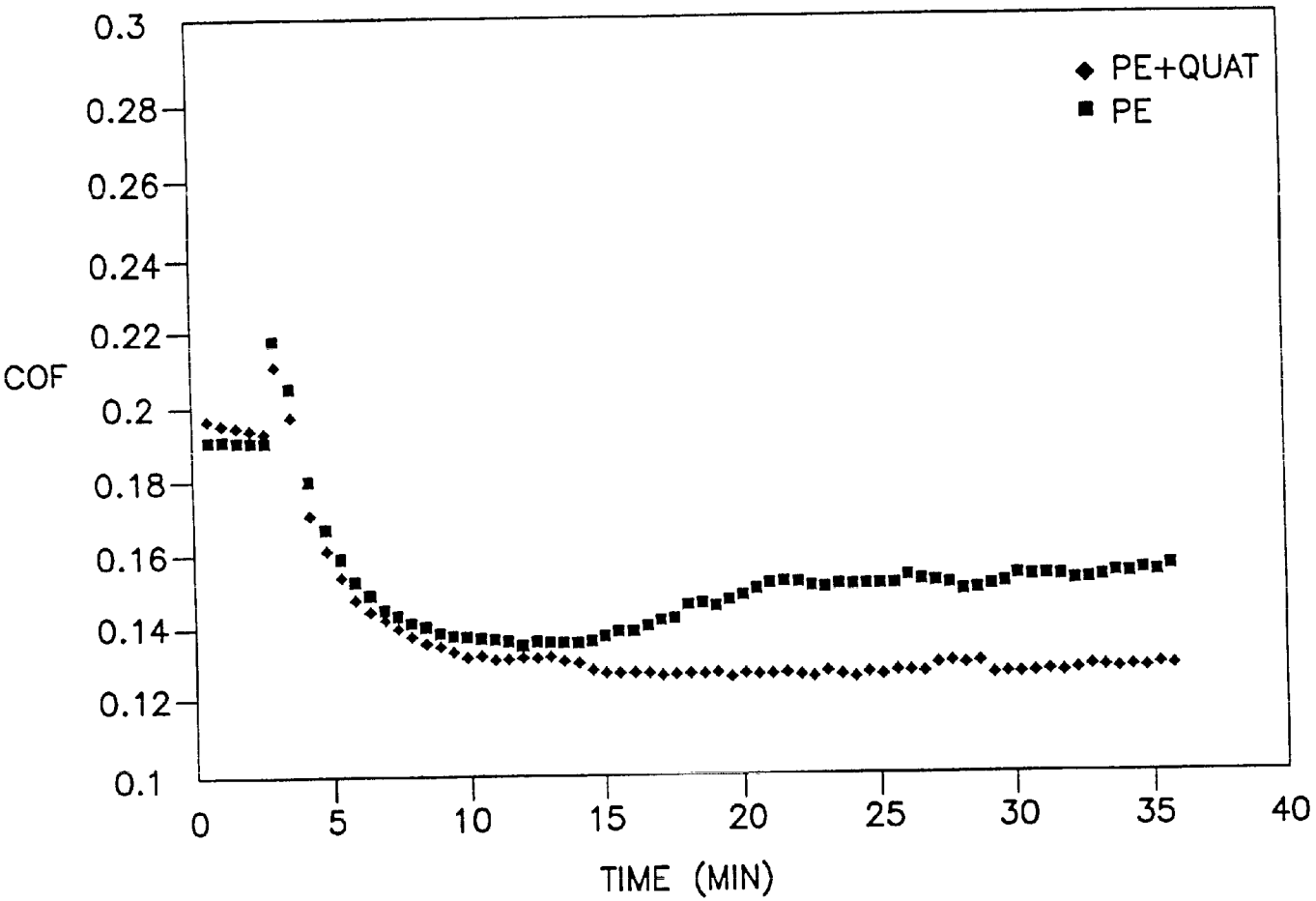
FIG. 1 shows a graph of data relating the kinetic Coefficient of Friction (kinetic COF) for phosphate esters alone, versus phosphate esters mixed with quaternary ammonium biocides.

Lubricating compositions of the invention, especially those designed for use in dairy product conveying systems, particularly those with high load-bearing requirements, comprise at least the following components:

a) an alkyl alkoxylated (e.g., ethoxylated or propoxylated, preferably ethoxylated) phosphate ester, b) a viscosity control agent selected from the group consisting of i) secondary alcohol alkoxylates, especially secondary alcohol ethoxylates and ii) a mixture of at least one secondary alcohol alkoxylate and at least one aryl (e.g., aromatic, such as phenol) alkoxylated (e.g., ethoxylated or propoxylated) phosphate ester, c) an aromatic or linear quaternary ammonium antimicrobial agent or mixtures thereof, and d) a liquid carrier, such as water.

The lubricating compositions are usually provided as concentrates which are diluted with the appropriate liquid (e.g., usually water) to up to a 400 times dilution to provide a use solution of the lubricant composition. These compositions are capable of providing a number of beneficial properties as lubricant use solutions, and especially as lubricant use solutions for conveying systems for dairy containers, including beverage containers. Each of the ingredients and the various types of properties sought for the lubricant compositions are described below. "Lubricant compositions" is a term used to cover both the lubricant concentrate and the lubricant use solution which is formed by dilution of the concentrate with the appropriate thinning liquid, usually water.

An alkyl alkoxylated (e.g., ethoxylated or propoxylated, preferably ethoxylated) phosphate ester has the general structural formula of:

$$R^1—O—\{R^2O\}_n—PO_3X_2$$

wherein $R^1$ comprises an alkyl group (e.g., linear, branched or cyclic alkyl group of from 1 to 20 carbon atoms, preferably of from 8 to 12 carbon atoms), $R^2$ is selected from $—CH_2—CH_2—$ and $$—\overset{\overset{\displaystyle CH_3}{|}}{CH}—CH_2— \text{(ethylene and propylene)}$$

n is 3 to 8 when $R^2$ is propylene, and 3 to 10 when $R^2$ is ethylene, and

X is hydrogen, an alkanolamine and/or an alkali metal.

The alkyl groups of $R^1$ may be variously substituted so as to provide a variety of subtle changes in its physical properties, especially with respect to its solubility (e.g., the addition of solubilizing groups or pH adjusting groups) and ionic qualities. Where the phosphate ester comprises an ethoxylated phosphate ester structure, another representative formula would be:

$$R^1—O—([CH_2]_2—O)n—PO_3X_2$$

wherein $R^1$ comprises an alkyl group (e.g., linear, branched or cyclic alkyl group of from 1 to 20 carbon atoms, preferably of from 8 to 12 or 10 to 12 carbon atoms), n is 3 to 8 or 3 to 10, preferably from 4 to 6 with a weight average of about 5, and X is hydrogen, an alkanolamine and/or an alkali metal.

An aromatic (e.g., aryl, phenol, naphthol, etc.) alkoxylated (e.g., ethoxylated or propoxylated) phosphate ester has the general formula of:

$$R^2R^3C_6H_3—O—\{R^4\}n—PO_3X_2$$

wherein $R^2$ and $R^3$ may be independently selected from the group consisting of hydrogen and alkyl group (e.g., linear, branched or cyclic alkyl group of from 1 to 20 carbon atoms, preferably of from 8 to 12 carbon atoms), $R^4$ is selected from $—CH_2CH_2—$ and $$—\overset{\overset{\displaystyle CH_3}{|}}{CH}—CH_2— \text{(ethylene and propylene),}$$

and n and X are as defined above.

Again, alkyl groups of $R^2$ and $R^3$ may be variously substituted so as to provide a variety of subtle changes in its physical properties, especially with respect to its solubility (e.g., the addition of solubilizing groups or pH adjusting groups) and ionic qualities. At the present time, it is preferred that $R^2$ and $R^3$ are hydrogen.

Secondary alcohol alkoxylates, and especially secondary alcohol ethoxylates encompasses a commercially available class of materials which may be narrowly described as non-ionic surfactants of secondary alcohols having chain lengths of 10 to 20, preferably 10–18, and more preferably 11–15 carbon atoms. Reference may be made to Nonionic Surfactants, Martin S. Schick, Marcel Dekker, Inc., N.Y., 1966, pp. 86–126. These types of materials are in part commercially provided as Tergitol ® surfactants, especially the Tergitol ® 15-S series of non-ionic surfactants. These surfactants are provided in a full range of surfactants made with this secondary alcohol hydrophobe, and includes 3, 5, 7, 9, 12, 15, 20, 30 and 40 mole ethoxylates. The commercial and trade descriptions of the Tergitol®, especially the Tergitol® Series, followed with a number (e.g., Tergitol® 15-S-5) indicates the average moles of ethylene oxide in the molecule. The compounds also may be narrowly defined according to the formula:

$$R^4—O(R^3O)_n—H$$

wherein $R^3$ comprises an alkyl group of from 1 to 20 atoms, and $R^4$ is a secondary alcohol group.

The compounds may be provided as mixtures with other alkoxylates and alkoxylates of alcohols and do not have to be added in a pure form. Non-linear alcohol alkoxylates and non-secondary alcohol alkoxylates and isomeric forms of the alkoxylated secondary alcohol may also be harmlessly present within the component and the final solution.

The aromatic and/or linear quaternary ammonium antimicrobial agents are materials generally known in the antimicrobial art. This class of compounds may be generally represented by the formula:

$$R^5R^6R^7R^8N^+X^-$$

wherein $R^5$, $R^6$, $R^7$ and $R^8$ are selected from the group consisting of aryl (e.g., phenyl, furyl, etc.), alkyl arene (e.g., benzyl), and alkyl group, with the proviso that no more than two may be aryl and/or alkyl arene. When any one or more of $R^5$, $R^6$, $R^7$ and $R^8$ are aryl or alkyl arene, the compound is referred to in the art as an aromatic quaternary ammonium compound. It is preferred that no more than two of $R^5$, $R^6$, $R^7$ and $R^8$ have more than 4 carbon atoms, with 8 to 18 carbon atoms being preferred for longer chain alkyl groups. It is possible to have all four of $R^5$, $R^6$, $R^7$ and $R^8$ have from 1 to 4 carbons atoms, with 8–18 carbon atoms preferred, and with independent variations in the number of carbon atoms in the groups and distribution of these groups within the compounds being acceptable. Commercial counterparts of these quaternary ammonium antimoicrobial agents include, but are not limited to Bardac 2250, Bardac LF, Bardac MB50 (all Bardac products from Lonza), Maquat LC-12S, Maquat 4450-E, Maquat 2525 (all Maquat materials from Mason Chemical Co.), BTC 50, BTC 65, BTC 99, BTC 2125 (all BTC materials from Stepan Chemical Co.), and the like.

The arylolalkoxylates may also be found commercially, particulalrly in the Rhodafac materials provided by Rhone-Poulenc (e.g., Rhodafac RE-410, RE-610, RE-960, RM-410, RE-510, RM-710, BP-769 alkylphenol ethoxylates (especially nonylphenol ethoxylates) and the like. The aromatic phosphate esters are also commercially available, as for example as DePhos PE-481, PE-786, RA-831 aromatic phosphate esters (from DeForest Enterprises), and Chemfac NB-0141T, NC-004K, NB 014 1T, PB-082K and PN-322 aromatic phosphate esters from Chemax, Inc.

The composition of the invention optionally may contain a basic compound (as well understood in the lubricant art), e.g., an alkali metal hydroxide, ammonium salt, amine or mixtures thereof to control the pH. The composition may have a pH of less than 8.5, a pH less than 8.0 and also a pH between 4.5 and 8.0 or 6.0 and 8.0. The control of the pH level within the range of about 6.0 to about 8.5 has been found to provide another benefit to the compositions of the present invention. The microbial activity of the compositions tends to increase significantly when the compositions of pH 6.0 to 8.5 have their pH levels reduced, as by contact with acidic beverages (which most commercial beverages and juices are). This increased activity upon exposure to beverages with a pH lower than that of the lubricant preserves the antimicrobial activity until such time as the activity is needed most, when sustenance is provided for the growth of the microbes, e.g., by the spillage of beverages. As the presence of the beverage tends to reduce the pH of the lubricant, the activity of the antimicrobial agent is better preserved and more efficiently used by such activation.

Although the lubricant compositions of the present invention are novel with any combination of a) an alkyl alkoxylated (e.g., ethoxylated or propoxylated, preferably ethoxylated) phosphate ester, b) a viscosity control agent selected from the group consisting of I) secondary alcohol alkoxylates, especially secondary alcohol ethoxylates and ii) a mixture of at least one secondary alcohol alkoxylate and at least one aryl (e.g., aromatic, such as phenol) alkoxylated (e.g., ethoxylated or propoxylated) phosphate ester, c) an aromatic or linear quaternary ammonium antimicrobial agent or mixtures thereof, and (with or without a liquid carrier) there are ranges and proportions of these combinations which provide improved or enhanced performance as compared to the broad range of compositions. For example, the relative proportion of anionic to cationic materials in the lubricant composition (i.e., the relative proportions of the combined total of phosphate ester [anionics] compared to the total of quaternary ammonium antimicrobial agents on a weight to weight basis) is believed to affect the degree to which sedimentation, precipitation, cloudiness and deposits occur in at least certain of the lubricant compositions when contacted with beverages. The higher the proportion of anionics to cationics, the more strongly the compositions resist deposits. It is preferred that the proportion of cationics to anionics is at least 1.5, usually within the range of 2.0 to 10.0, more preferably within the range of 2.0 to 8.0. As noted, the greater the amount of beverage to which the lubricant is likely to be exposed, the higher the preferred ratio of anionics to cationics. The proportions of materials within the concentrate compositions may also be described in terms of 7–30 weight percent anionic materials and 1–5 weight percent cationic materials. These percentages allow for a maximum range of about 30:1 to 1.28:1 ratios by weight of anionic materials to cationic materials. Unless otherwise stated, all proportion described in the examples are percentages by weight.

Additional ingredients which do not significantly and adversely affect the stability and lubricating properties of the composition may also be present in the compositions of the invention. Coupling agents, that is materials which have an affinity for both hydrophilic and hydrophobic materials may be included within the compositions. Coupling agents are also referred to as hydrotropes, chemicals which have the property of increasing the aqueous solubility of variously slightly soluble organic compounds. The compounds often have both hydrophilic and hydrophobic functionalities within a single molecule to display affinity to both environments, and are commonly used in the formulation of liquid detergents.

Another attribute of the present invention is that the lubricants of the invention tend to have a wider range of utility with respect to the container material and the conveyor material. It has usually been the practice in the art to specifically design lubricant compositions for use with particular container compositions and conveyor support materials. The supporting surfaces on conveyors may comprise fabric, metal, plastic, composite and mixtures of these materials. Lubricants would preferably be compatible with a variety of these surfaces. Similarly, bottle compositions may comprise metals, glasses, papers, treated papers, coated papers, laminates, ceramics, polymers, and composites, and the lubricant compositions would preferably have a range of compatibility with all of these materials. Although there may be some variation in the quality of performance with certain materials, the lubricants of the present invention do tend to display a greater latitude in acceptable performance with a range of materials than many lubricant compositions.

Possible optional agents with high degrees of utility include chelating agents (e.g., EDTA), nonionic detergents, and alkalating agents, e.g, potassium, sodium hydroxide, or alkanolamines. The preferred chelating agents for use in the practice of the present invention are the amine-type acetic acids. These chelating agents typically include all of the poly(amine-type) chelating agents as described in U.S. Pat. No. 4,873,183. Other chelating agents such as nitrilotriacetic acid, alkali metal salts of glucoheptanoate, and organic substituted phosphoric acid, and their equivalents are also useful in the practice of the present invention. The chelating agents are preferably present as from 0.05 to 10% by weight of the lubricant concentrate composition, preferably from 0.05 to 2% by weight.

In a synthetic lubricant environment, the invention has found that quaternary ammonium antimicrobial agents, and especially the linear quaternary compounds act as lubricants in combination with the linear and phenol phosphate esters. At least one of the referenced art (e.g., PCT GB95/01641, page 17, lines 12–18) specifically shows that the combination of quaternary ammonium compounds with the alkyl (linear) phosphate esters did not affect lubricity. The finding that the combination of the quaternary ammonium antimicrobial agents with the combination of esters of the present invention actually increases lubricity (reduces the coefficient of friction) provides a basis for the assertion of unexpected results in the defined chemical classes of compounds.

Exemplary Formula

| Raw Material | Chemical Name | (%) |
|---|---|---|
| Soft water | | 65.5 |
| Phosphate Ester | $C_{10-12}$ alkyl phosphate ester, 5 EO units | 12.5 |
| | phenol ethoxylated phosphate ester | 2.50 |
| | didecyl dimethyl ammonium chloride, 50% | 5.0 |
| | Tetrasodium EDTA, 40% | 10.0 |
| | NaOH (NaOH, 50%) | 02.0 |
| | $C_{12-15}$ linear alcohol, 7 EO | 2.50 |
| | | 100.0 |

Background Example A

Two formulae were prepared as set out below. The first formula contained the blended phosphate esters, EDTA, NaOH, and linear quaternary ammonium antimicrobial agent. The second formula was identical with the exception of the linear quat.

0.1% use solutions of each formula were prepared in softened water. This solution was sprayed on the short track conveyor which was set up with glass bottles held stationary as the stainless steel conveyor rotated at 100 rpm. The drag was measured with a load cell, which was in turn connected to a computer which plotted the COF (kinetic) based on the drag and the load. The results are presented below in FIG. 1, a graph displaying the coefficient of friction (COF) versus time for a phosphate ester with a linear quat versus a phosphate ester used alone.

Formulas

| Raw Material | Chemical Name | Formula (%) 10-1 | 10-2 |
|---|---|---|---|
| Soft Water | | 68.0 | 73.0 |
| A1 | $C_{10-12}$ alkyl phosphate ester, 5 EO units | 12.5 | 12.5 |
| A2 | phenol ethoxylated phosphate ester | 2.5 | 2.5 |
| A3 | Tetrasodium EDTA, 40% | 10.0 | 10.0 |
| | NaOH (NaOH, 50%) | 2.0 | 2.0 |
| A4 | didecyl dimethyl ammonium chloride, 50% | 5.0 | 0.0 |
| | | 100.0 | 100.0 |

Conclusions

The inclusion of linear quat in the formula improves the lubricity over a lubricant containing only the blend of phosphate esters.

Background Example B

Two formulas of lubricating agents were prepared as set out below. The first formula contained the blended phosphate esters, EDTA, NaOH, nonionic surfactant, and linear quaternary ammonium antimicrobial agent. In the second formula, the linear quaternary ammonium antimicrobial agent was replaced with benzyl quat.

Figure 2:
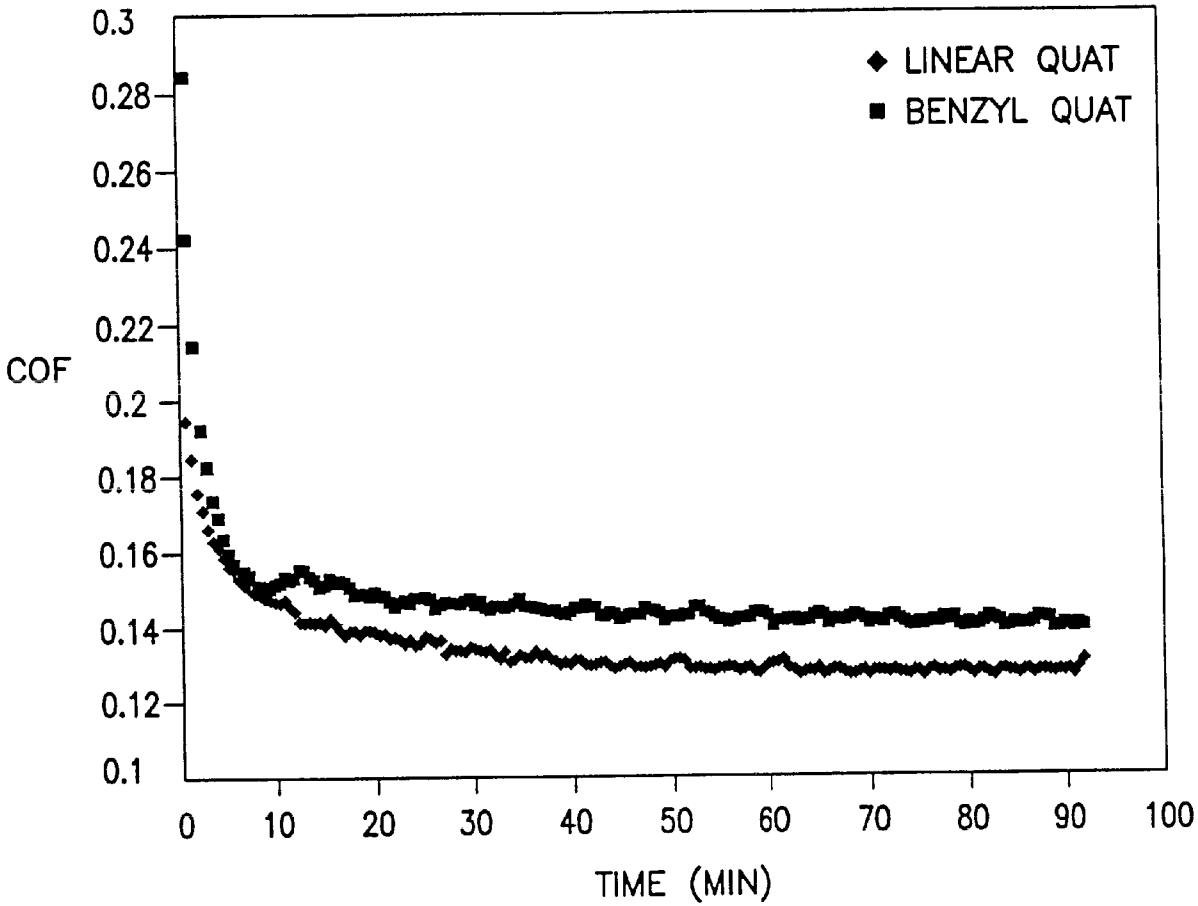
FIG. 2 shows a graph of data relating the Coefficient of Friction (kinetic) of phosphate esters lubricating compositions containing either linear quaternary ammonium biocides or aromatic quaternary ammonium biocides.

0.1% use solutions of each formula were prepared in softened water. This solution was sprayed on the short track conveyor which was set up with glass bottles held stationary as the stainless steel conveyor rotated at 100 rpm. The drag was measured with a load cell, which was in turn connected to a computer which plotted the COF (kinetic) based on the drag and the load. The results are presented in FIG. 2 which shows a comparison of COF versus time for phosphate esters with either a linear quat or a benzyl quat.

Formula

| Raw Material | Chemical Name | Formula (%) Comp. 1 | Comp. 2 |
|---|---|---|---|
| Soft Water | | 68.0 | 68.0 |
| A1 | $C_{10-12}$ alkyl phosphate ester, 5 EO units | 12.5 | 12.5 |
| A2 | Phenol ethoxylated phosphate ester | 2.5 | 2.5 |
| A3 | Tetrasodium EDTA, 40% | 10.0 | 10.0 |
| | NaOH (NaOH, 50%) | 2.0 | 2.0 |
| A4 | didecyl dimethyl ammonium chloride, 50% | 5.0 | 0.0 |
| | benzyl quat, 50% (a mixture of alkyldimethyl-benzyl ammonium chlorides) | 0.0 | 5.0 |
| | | 100.0 | 100.0 |

Conclusions

The linear quat species improves the lubricity of the formula as compared to the benzyl quat.

Background Example C

Two formulae were prepared as set out below. The first formula contained blended alkyl and aryl phosphate esters and the second formula contained only alkyl phosphate ester. Both formulas contained EDTA, nonionic, NaOH, and linear quat.

The viscosity of the concentrates was measured in triplicate on a Brookfield viscometer model RVT at 51, 78 and 116° F. (spindle #3, 100 rpm, factor 10). The results are provided below.

Formula

| Raw Material | Chemical Name | Formula (%) | |
|---|---|---|---|
| Soft Water | | 65.5 | 65.5 |
| A1 | $C_{10-12}$ alkyl phosphate ester, 5 EO units | 15.0 | 12.5 |
| | Tetrasodium EDTA, 40% | 10.0 | 10.0 |
| | NaOH (NaOH, 50%) | 2.0 | 2.0 |
| A4 | didecyl dimethyl ammonium chloride, 50% | 5.0 | 5.0 |
| | $C_{12-15}$ linear alcohol, 7 EO | 2.5 | 2.5 |
| A2 | phenol ethoxylated phosphate ester | | 2.5 |
| | | 100.00 | 100.00 |

Results

| Temperature (° F.) | Phosphate Ester(s) | Average Viscosity (cps) |
|---|---|---|
| 51 | Alkyl and Phenol blend | 50 |
| 78 | Alkyl and Phenol blend | 51 |
| 116 | Alkyl and Phenol blend | 49 |
| 51 | Alkyl | 170 |
| 78 | Alkyl | 132 |
| 116 | Alkyl | 64 |

Conclusions

Blending phenol phosphate ester with alkyl phosphate ester in the formula reduces the viscosity at all temperatures tested and the resultant low viscosity appears to be temperature independent. This property provides for ease of application on a conventional conveyor apparatus.

Background Example D

Formulas containing alkyl phosphate ester and linear quat were prepared with various nonionic and anionic adjuvants to determine the affect on lubricity. A control containing phenol phosphate ester, a control with higher level of alkyl phosphate ester, and a control with no adjuvant were prepared for comparative purposes. The formulas are provided below.

Figure 3:
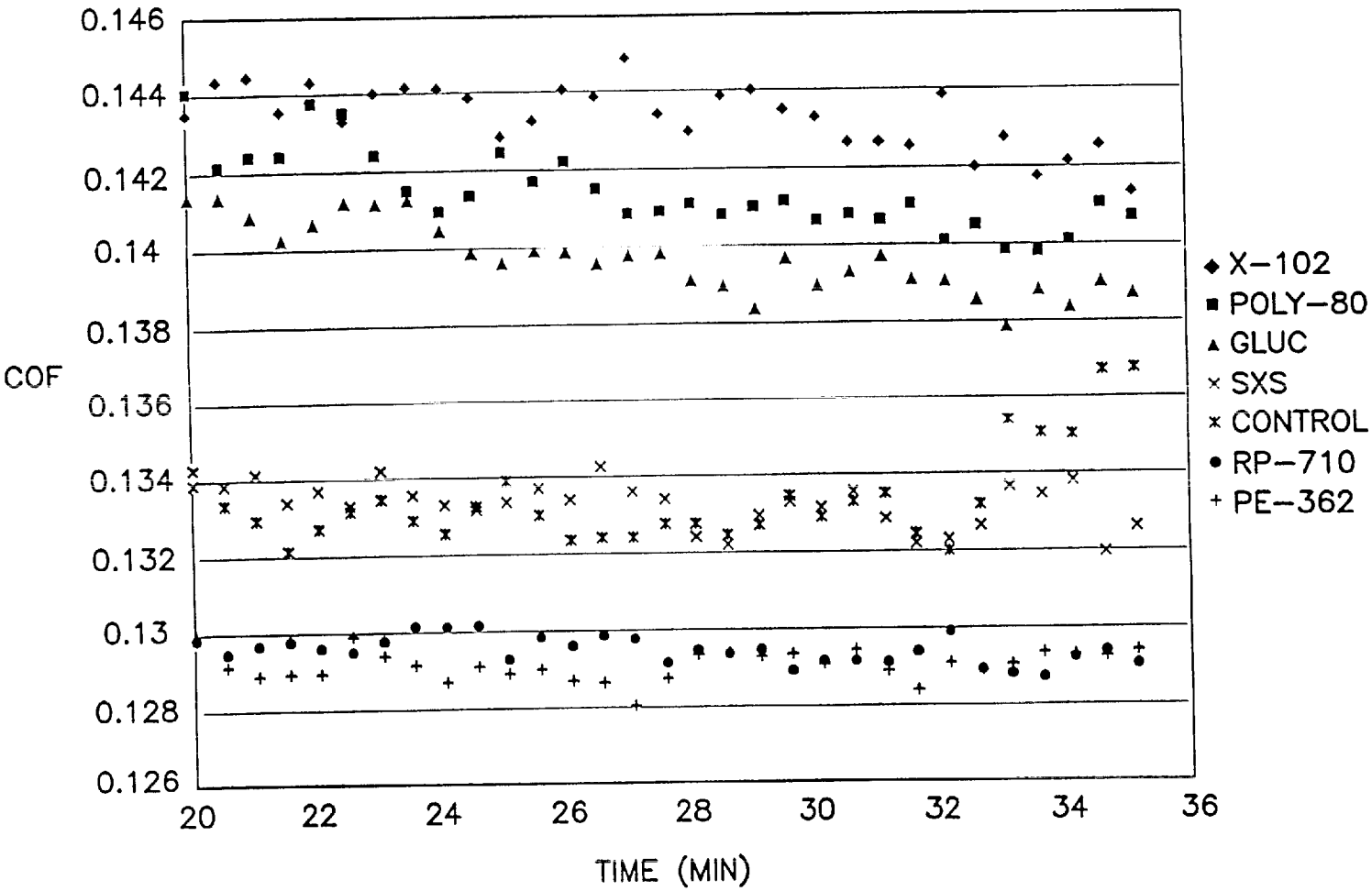
FIG. 3 shows a graph of data relating the Coefficient of Friction (kinetic) for a lubricant composition of the invention as compared to various lubricant compositions with various couplers (e.g., hydrotropes).

0.1% use solutions of each formula were prepared in softened water. This solution was sprayed on the short track conveyor which was set up with glass bottles held stationary as the stainless steel conveyor rotated at 100 rpm. The drag was measured with a load cell, which was in turn connected to a computer which plotted the COF based on the drag and the load. Each sample was run two or more times, and the average COF was calculated. The results are provided in FIG. 3.

Formulas

TABLE A

| Raw Material | Chemical Name | 1 | 2 | 3 | 4 | 5 | 6 | 7 |
|---|---|---|---|---|---|---|---|---|
| Soft Water | above | 68.00 | 65.50 | 61.70 | 65.50 | 65.50 | 65.50 | 65.50 |
| A1 | above | 12.50 | 15.00 | 12.50 | 12.50 | 12.50 | 12.50 | 12.50 |
| A3 | above | 10.00 | 10.00 | 10.00 | 10.00 | 10.00 | 10.00 | 10.00 |
| NaOH, 50% | above | 2.00 | 2.00 | 2.00 | 2.00 | 2.00 | 2.00 | 2.00 |
| A4 | above | 5.00 | 5.00 | 5.00 | 5.00 | 5.00 | 5.00 | 5.00 |
| $C_{12-15}$ linear alcohol | above | 2.50 | 2.50 | 2.50 | 2.50 | 2.50 | 2.50 | 2.50 |
| SXS, 40% | Na xylene Sulfonate | | | 6.30 | | | | |
| A2 | above | | | | 2.50 | | | |
| A5 | sorbitan monooleate | | | | | 2.50 | | |
| A6 | Alkyl poly glycoside | | | | | | 2.50 | |
| Total | | 100.00 | 100.00 | 100.00 | 100.00 | 100.00 | 100.00 | 100.00 |

Conclusions

The phenol and alkyl phosphate esters improved lubricity over the control, while none of the other adjuvants showed this advantage.

Background Example E

This example examines the ratios of phosphate ester and quat which do not interact with beverage to form a precipitate. A 40% phosphate ester solution in soft water was combined with 10% active linear quat solution in water and a cola beverage at various levels. After one day, the samples were observed for clarity. Samples were rated as clear, hazy, and separated. (Over time, all hazy samples formed precipitates.)

Results

Figure 4:
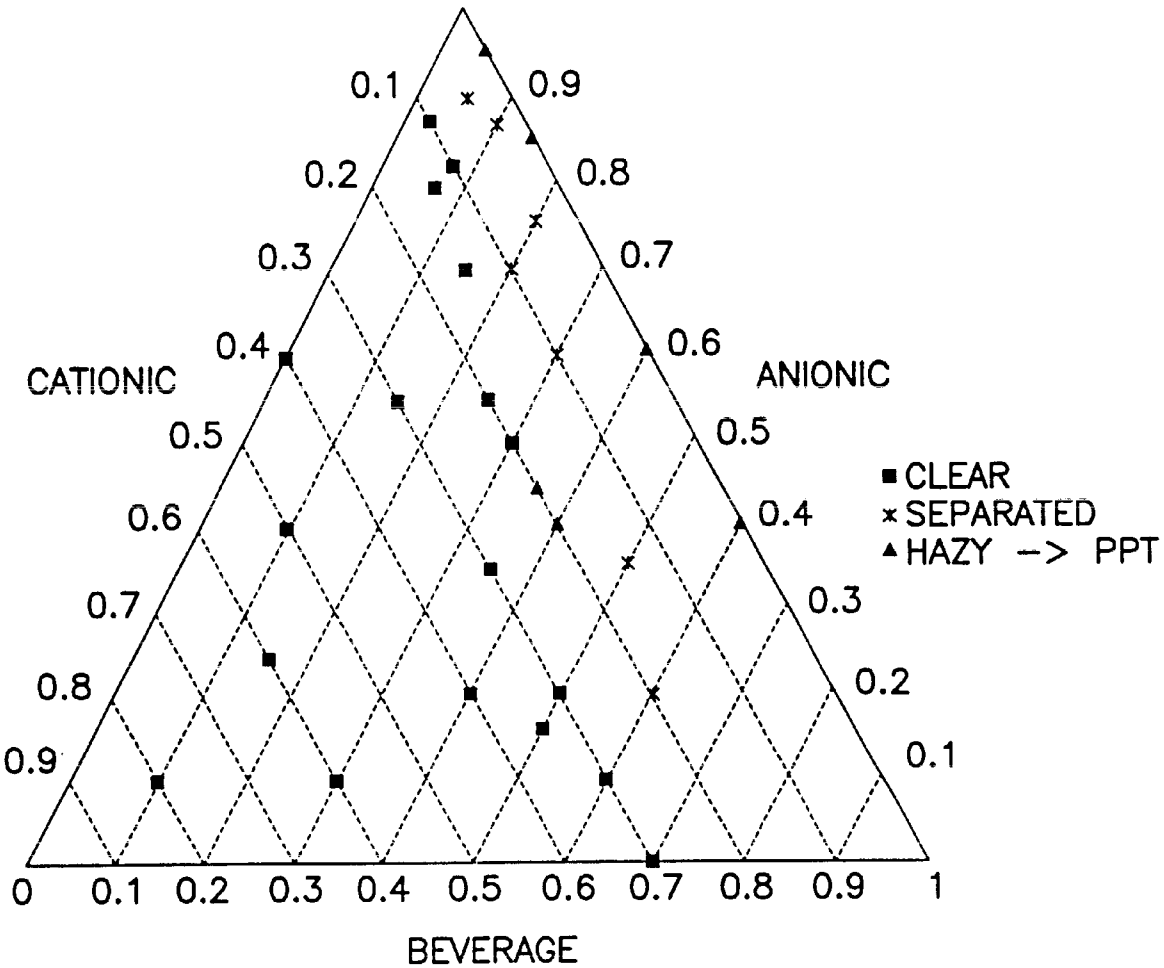
FIG. 4 shows a triangular graph of the effects of variations among anionic surfactants, cationic surfactants and beverage.

See the ternary plot in FIG. 4.

Conclusions

At higher levels of beverage a higher ratio of anionic to cationic surfactant is required to maintain clarity. The ratio ranges from about 1.5:1 at very low levels of beverage, to 2.5:1 at 50% beverage and 16:1 at very high levels of beverage.

EXAMPLES OF THE INVENTION

The present examples of the invention are further enabled and taught in the following non-limiting examples. Amongst other aspects of the invention that are evidenced by these non-limiting examples is at least the fact that some of the lubricating compositions not only maintain the effective performance of the conveying systems to which they are applied, even under high stress or high load-bearing conditions, but also that some of the lubricating compositions have improved the appearance of the metal on the conveying system, visibly increasing the shine on the exposed metal. These and other aspects of the invention are shown in the accompanying examples.

The lubricant may also comprise a triazole, such as a triazole with an aromatic substituent, such as a triazole is selected from the group consisting of benzotriazole and tolyltriazole. In the performance of the process of the invention, the presence of a triazole, where there is application of the composition to a used metallic conveying surface and operation of said conveyor, the composition increases the luster of said metallic conveying surface.

Example 1

Non-Phenolic Lubricant

The purpose of this Example is to examine the compatibility of the a lubricant of the related art (Commonly assigned U.S. Ser. No. 09/002976, filed on Jan. 5, 1998) with mild steel.

Two lubricant systems, one according to the related art (Commonly assigned U.S. Ser. No. 09/002976, filed on Jan. 5, 1998) are primarily used in these comparisons. These solutions are referred to herein as RA-1 (of the related art) and Solution 1 of the present invention. Solution 1 is prepared as follows:

| | |
|---|---|
| 1. Deionized Water | 64.75 |
| 2. A4 | 5.0 |
| 3. A1 | 12.5 |
| 4. Propylene Glycol | 1.0 |
| 5. NaOH 50% | 1.25 |
| 6. A8 (triethanol amine/ phosphoric acid/ aminotrimethylene phosphoric acid) | 5.0 |
| 7. A9 (secondary alcohol alkoxylate) | 1.0 |
| 8. A10 (linear alcohol alkoxylate) | 1.5 |
| 9. Tetrasodium EDTA | 5.0 |
| 10. Triethanol amine | 3.0 |

The mixing procedures were as follows:

1. Provide the water. 2. Mix for 5 mins—solution is clear. 3. Mix for 5 mins—solution is hazy. 4. Mix for 5 mins—solution is hazy. 5. Mix for 5 mins—slightly hazy. 6. Mix for 5 mins—yellow, slightly hazy. 7. Mix for 5 mins—yellow, slightly hazy. 8. Mix for 30 mins—yellow, slightly hazy. 9. Mix for 5 mins—yellow, slightly hazy. 10. Mix for 5 mins—yellow, sl. hazy Lubricating solution RA-1 has the amounts of the ingredients are as follows:

| | |
|---|---|
| 1. Deionized Water | 60.0 |
| 2. A4 | 5.0 |
| 3. A1 | 12.5 |
| 4. Propylene Glycol | 2.5 |
| 5. NaOH 50% | 2.0 |
| 8. A10 | 8.0 |
| 9. Tetrasodium EDTA | 10.0 |

The Procedure for the testing of the solutions was to load a 1"×3" (2.5×7.6 cm) coupon of mild steel in 0.7% (v) soft water solution at Room Temperature (Rt) and compare the physical/chemical effects with immersion of the coupon into lubricant solutions of the invention. "Sl." is used to identify a slight characteristic and "Mod." is used to identify a moderate characteristic. . . .

| 24 hr | 1020 steel | 1018 steel |
|---|---|---|
| $H_20$ | Surface darkening (24 hr) | Surface darkening (24 hr) |
| Solution 1 | Sl. pitting at top (24 hr) | Mod. pitting at top (24 hr) |
| Sani-Glide ™ (a fatty acid-based lubricant) | Very Sl pitting at top (24 hr) | Slight pitting throughout the surface (24 hr) |
| RA-1 | S1.- Mod. Pitting at top with surface darkening | |

| 72 hour | 1020 steel | 1018 steel |
|---|---|---|
| $H_20$ | Surface darkening | Surface darkening |
| Solution 1 | Sl. pitting at top | Mod. pitting at top |
| Sani-Glide ™ | Very Sl. pitting at top | Sl. pitting throughout |

Example 2

The purpose of these examples is to determine if Solution 1 permeates HDPE (High Density Polyethylene)

Procedure: 3×16 oz. HDPE cylindrical bottles were filled with 100 ml of DI water and then placed in a 4 Liter beaker containing 500 ml. of lubricating solution. Periodically the contents of the bottles were checked for foam by pouring contents into 8 oz. glass jars and shaking. A central bottle containing 100 ml of (Deionized water) DI was used to compare foam. Where dashes (–) are present in the date, that indicated that no foaming occurred. A completely blank space indicates that no observation was made or data taken. Where a plus sign (+) appears, some foaming was noted, indicating that the HDPE had been permeated by the composition being tested.

| Lube | Conc. | 1 hr. | 3 hr. | 24 hr. | 96 hr. |
|---|---|---|---|---|---|
| Sani-Glide ™ | 0.7% | — | — | — | — |
| | | — | — | — | — |
| | | — | | — | — |
| Solution 1 | 0.7% | — | | — | — |
| | | — | | — | — |
| | | — | | +* | * |
| Water | Control | — | | | |

*This sample was accidentally contaminated with the lubricating solution - The solution had dripped onto the cover of glass jar used to seal the container during testing. The remaining two tests for a composition of the invention shows no foaming.

Example 3

The purpose of this example was to compare the lubricity of Solution 1 versus that of RA-1 using slider testing (as understood in the art and as described herein).

Procedure: 1×3 1020 mold steel coupons were cleaned in 1% Ultrasil 390 using a soft scrubbing powder, rinsed with DI water and acetones, 200 ml of 0.7% test solvents and placed in 8 oz. Bottles along with one test coupon. The

| | | | Stainless/Mild Steel | | | | |
|---|---|---|---|---|---|---|---|
| SAMPLE | CONC | DILUENT | LUBE USE CONC | FORCE, g | L = 227 g COF | RUN ORDER | Rel COF |
| LubriKleanz ™ | 0.1 | DI | 0.1 | 26 | 0.1145 | 1 | 1 |
| Sani-Glide ™ | 0.1 | DI | 0.1 | 24 | 0.1057 | 2 | 0.949 |
| Sani-Glide ™ | 0.25 | DI | 0.25 | 23.5 | 0.1035 | 3 | 0.955 |
| Sani-Glide ™ | 0.5 | DI | 0.5 | 24 | 0.1057 | 4 | 1.004 |
| Sani-Glide ™ | 0.75 | DI | 0.75 | 26.5 | 0.1167 | 5 | 1.142 |
| LubriKleanz ™ | 0.1 | DI | 0.1 | 22.5 | 0.0991 | 6 | 1 |
| LubriKleanz ™ | 0.1 | DIW | 0.1 | 22.5 | 0.0991 | 1 | 1 |
| LubriKleanz ™ | 0.1 | DI | 0.1 | 24 | 0.1057 | 2 | 1.076 |
| LubriKleanz ™ | 0.25 | DI | 0.25 | 24.5 | 0.1079 | 3 | 1.109 |
| LubriKleanz ™ | 0.5 | DI | 0.5 | 25 | 0.1101 | 4 | 1.142 |
| LubriKleanz ™ | 0.75 | DI | 0.75 | 25 | 0.1101 | 5 | 1.152 |
| LubriKleanz ™ | 0.1 | DI | 0.1 | 21.5 | 0.0947 | 6 | 1 |
| LubriKleanz ™ | 0.1 | DI | 0.1 | 21.5 | 0.0947 | 1 | 1 |
| RA-1 | 0.1 | DI | 0.1 | 23 | 0.1013 | 2 | 1.066 |
| RA-1 | 0.25 | DI | 0.25 | 23 | 0.1013 | 3 | 1.061 |
| RA-1 | 0.5 | DI | 0.5 | 23.5 | 0.1035 | 4 | 1.080 |
| RA-1 | 0.75 | DI | 0.75 | 23.5 | 0.1035 | 5 | 1.076 |
| Solution 1 | 0.5 | DI | 0.5 | 24 | 0.1057 | 6 | 1.095 |
| KleanEase ™ | 0.1 | DI | 0.1 | 22 | 0.0969 | 7 | 1 |

The purpose of these examples is to show the effect of the addition of corrosion inhibitors to Solution 1.

The solutions compared were:

Lubricating Solutions according to the practice of the present invention are identified in relationship to Solution1 which is completely defined above. The solutions of the

| | Sol. 1 | 1 | 2 | 3 | 4 | 5 | 6 |
|---|---|---|---|---|---|---|---|
| Deionized Water | 67.75 | 67.75 | 66.50 | 66.5 | 66.5 | 67.75 | 67.75 |
| A4 | 5.00 | 5.00 | 5.00 | 5.00 | 5.00 | 5.00 | 5.00 |
| A1 | 12.50 | 12.50 | 12.50 | 12.50 | 12.50 | 12.50 | 12.50 |
| Propylene Glycol | 1.00 | 1.00 | 1.00 | 1.00 | 1.00 | 1.00 | 1.00 |
| A10 Linear Alc. Ethox. | 1.50 | 1.50 | 1.50 | 1.50 | 1.50 | 1.50 | 1.50 |
| A9 | 1.00 | 1.00 | 1.00 | 1.00 | 1.00 | 1.00 | 1.00 |
| Tetrasodium EDTA | 5.00 | 5.00 | 5.00 | 5.00 | 5.00 | 5.00 | 5.00 |
| Triethanol amine | 0.25 | 0.25 | 0.25 | 0.25 | 0.25 | 0.25 | 0.25 |
| A11 | 5.00 | 5.00 | 5.00 | 5.00 | 5.00 | 5.00 | 5.00 |
| aminated polyglycol | | 1.00 | | | | | |
| Dequest* | | | 1.00 | 1.00 | 1.00 | | |
| Oleoyl sarcosinel | | | | | | 1.00 | |
| TEA, phosphoric acid/ amino-trimethylene phosphoric acid) A12 | | | | | | | 1.00 |
| A11 | | | | | | | |
| Benzotriazole | | | | 0.002 | | | |
| tolytriazole | | | | | 0.002 | | |
| NaOH 50% | 1.00 | | 1.25 | 1.25 | 1.25 | 1.00 | 1.00 |
| | 100.00% | 100.00% | 100.00% | | | 100.% | 100.00% |
| | | | | | | | 0.346 |
| | | | | | | | 1.034 |
| | | | | | | | 2.977 |

The purpose of these examples was to evaluate erosion studies on formulas for lubricating compositions according to the present invention:

present invention are referred to as, for example, 1, which comprises Solution1 to which was added the specified ingredients as follows:

| Sample | Description | Initial weight | 96 hr. Final Weight |
|---|---|---|---|
| Sani-Glide ™ 0.06534 g | | 41.7505 | 41.7494 |
| Solution 1 0.09801 g | | 44.5632 | 44.5623 |
| 1 | Solution1 + APG 0.1634 g | 44.7505 | 44.7490 |
| 2 | Solution1 + Dequest 2010 0.1634 g | 44.5128 | 44.5113 |
| 3 | Solution1 + Oleyl sarcosine 0.1307 g | 44.0477 | 44.0465 |
| 4 | Solution1 + A12 0.0218 g | 44.6469 | 44.6467 |
| 5 | 1 + Benzotriazole 0.1198 g | 44.9271 | 44.9260 |
| 6 | 1 + Tolyltriazole 0.08712 g | 44.0679 | 44.0671 |
| $H_20$ | 0.03267 g | 44.0580 | 44.0577 |

The following examples were performed to examine the wicking properties of the lubricating solutions of the invention and the related art. The wicking test on new milk cartons with Solution 1 was Klengard test method #28. ½ gallon milk carton (in duplicate) were used. Sani-Glide (0.7%) and water were used as controls. Solution 1 was run at 0.7% (v) and 0.5% (u). The results I comparison with solution 1–6 were clearly negative—no lye was found leaking through the milk cartons using the lubricating compositions of the present invention or the related art.

The purpose of the following examples was to evaluate corrosion studies on solutions 1, 2 and 3.

Procedure: 1"×3" (2.54×7.62 cm) 1020 mild steel coupons were cleaned in 1% Ultraril™ 390 using a soft scrub powder, and a rinse with DI water and acetone. 200 ml of 0.7% test solutions were placed in 8 oz (0.252 L) jars along with one test coupon for 96 hr. Wi represents the initial weight, Wf represents the final weight, and MPY represents the mass per year which would have been lost. The capital letters (A and B) indicate repeated tests of the same solutions.

| Sample | Description | Wi | Wf | MPY |
|---|---|---|---|---|
| Sani-Glide | 45.0263 | 45.0258 | 0.05444 | |
| Sani-Glide | 44.3664 | 44.3658 | 0.06534 | |
| 1A | Dequest 2010 | 43.7456 | 43.7450 | 0.06534 |
| 1B | | 43.8712 | 43.8695 | 0.1851 |
| 2A | Dequest + TolylT | 44.0691 | 44.0647 | 0.4792 |
| 2B | | 44.0032 | 43.9982 | 0.5445 |
| 3A | TolylTriazine | 43.7317 | 43.7313 | 0.04356 |
| 3B | | 44.3025 | 44.3018 | 0.07623 |

The following procedures were used in the practice of the present invention and referred to as the Falex test. The apparatus used included commercially available friction and wear testing machines, the Falex™. The reagents used were toluene and isopropyl alcohol (IPA).

Sample Preparation: Prepare 2 liters of test lubricant solution in a 4 liter beaker. Test solutions are normally prepared by a wt/wt basis, by weighing the test lubricant to the nearest 0.01 g. Soft water was used when making up the solutions.

Procedure:

Recirculated Falex Lubricity Test

1. Remove 1 clean test pin and 2 clean 'vee' blocks from toluene bath with forceps. Place on soft cote towel and wipe the excess toluene off. Avoid touching any part of the mating surfaces (lower ¾ inch of the test pin and any portion of the v-grove on the 'vee' blocks).
2. Place on second soft cote towel and spray with IPA. Wipe off excess with soft cote towel and air dry using filtered air line hose.
3. Insert test pin into drive shaft and secure with brass shear pin. Place vee blocks into recesses of the loading device and swing the load arms inward to just contact the test pin. Align the 'vee' blocks so that the v-grove is in alignment with the test pin. DO NOT touch the mating surfaces when aligning.
4. Place the load gauge over the load arms and hand turn the ratchet wheel until the 'vee' blocks just contact the test pin (look at torque gauge for first sign of any pressure). Back off ½ turn.
5. Place recirculation cup on support and swing into position under vee blocks holder. Connect recirculation pump.
6. Pour lube solution into the test solution reservoir. Place pump pick-up probe in reservoir and start pump. Flow rate should be 800 ml/min or a reading of 100 on the flowmeter scale. Adjust pump speed accordingly. With the Masterflex pump the motor speed setting is approximately 7 depending on the condition of tubing, this rate may need periodic adjustments.
7. When the lube solution flow has stabilized, start the Falex™ drive motor. Place the ratchet arm on the ratchet wheel and advance slowly until it advances on its own. Allow it to advance until the load gauge reads 300 pounds. Remove ratchet arm from ratchet wheel.
8. Start 5 minute timer. Record initial warm up torque (in pounds). Maintain 300 pound load.
9. At the end of the 5 minute warm up period, record the final warm up torque (in pounds).
10. Replace ratchet arm on ratchet wheel and advance until gauge reads 765 pounds. Remove ratchet arm. NOTE: If the test fails (pin and vee blocks weld together) at any point, record the time into the test or pounds reached when failure occurred and stop test immediately.
11. Start 15 minute timer. Record initial torque. Place 1"×3" metal coupon on load arms, then read and record the tooth number from the ratchet wheel.
12. Maintain load gauge at 765 pounds by engaging the ratchet arm when the load drops below 760 pounds.
13. Record the torque every 2.5 minutes.
14. At the end of 15 minute test, record the final torque and the final tooth number. Turn off Falex™, drive the motor and the recirculation pump. Run recirculation pump in reverse until lines are completely flushed out.
15. Remove recirculation cup and discard solution. Discard reservoir solution. Remove test pin and 'vee' blocks from their holders. Examine test pin and vee blocks for wear and any build up of material. Place test pin and 'vee' blocks in small, labeled, poly bags.
16. Spray Falex™ 'vee' block holders and test pin holder with IPA. Air blow dry all surfaces.

Metal Corrosion Test

This test method describes an accepted, but not exclusive, procedure for metal corrosion testing as outlined in the American Society for Testing and Materials (ASTM), Volume 3.02, G31–72 and 3.02, G1–90, and as outlined in the Klenzade™ Good Laboratory Practice standard test method, K004–01–01, which is in compliance with Environmental Protection Agency (EPA) registration and UN/DOT for corrosion testing.

The ASTM and Klenzade™ Good Laboratory Practice (GLP) test method K004–01–01 were written to cover a wide range of corrosion testing situations. This procedure was written to give a detailed description of an accepted method for EPA and UN/DOT corrosion testing. See the attached ASTM methods and Klenzade™ Good Laboratory Practices test method K004–01–01 for further reference.

Metal strips are pre-cleaned, weighed, and put into glass bottles with product solution (100% concentration for UN/DOT) and placed at appropriate temperature (130° F. or 54.5° C. for UN/DOT). After the specified time, the corroded metal strips are then cleaned, weighed, and weight loss is determined. Corrosion rates are directly proportional to the mass loss of the metal strip and inversely proportional to the strip area, density, and time of exposure to the test solution. A corrosion rate exceeding 250 mpy is classified as UN/DOT corrosive to the test metal.

Metal Strip Preparation—Pre-cleaning

1. Identify each metal strip by using steel stencil stamp. Prepare at least duplicates per test condition and metal type, and duplicate controls per metal type being tested.
2. Pre-clean all metal strips.
3. Clean soft metals such as galvanized steel (zinc), aluminum, brass, copper, and nickel with detergent (EXPRESS) and a soft sponge. Then, ultrasonic clean in toluene for 30 minutes. Scrubbing with an abrasive powder and pad can mar the surface, increasing surface area which could increase corrosion results.
4. To clean hard metals, such as cold rolled steel 1018 and stainless steel 304 and 316, scrub with bleach-free scouring powder, Bon Ami used.
5. Rinse metal strips with distilled water followed with an acetone rinse.
6. Let metal strips air dry. Store strips in desiccator until used. Aluminum and copper should be stored a minimum of 24 hours in a desiccator before testing to allow protective coatings to reform on the test panel surface.
7. Weigh the clean, dry, metal strips and controls (pre-cleaning weight) on an analytical balance. EPA (Environmental Protection Agency) GLP (Good Laboratory Practices) work must be weighed on an approved balance.

Test Conditions

1. Determine temperature desired for testing. Temperature of testing is generally ambient (68–72° F.) for EPA GLP or 130° F. for LN/DOT.
2. Label containers. The standard container is a one-liter, wide-mouth glass jar. Test metal strips should be supported in the standard container so that the metal strip is no less than 45 degrees relative to the horizontal plane. Glass panels are inserted vertically in the standard container as a support with the metal strip resting against it with as little contact as possible to obtain this angle.
3. Make desired test concentrations. Solution should be made on a percent by weight basis. For UN/DOT testing, product is undiluted, 100% concentration. Test volume should be approximately 125 ml per square inch of metal strip surface area, i.e., a 1×"3" metal strip requires 750 ml of test solution; a 0.5"×4" (1.27×10.2 cm) metal strip requires 500 ml of test solution.
4. The length of exposure should be determined using the following guideline:

Number of Hours=2000/mpy (Estimated)

Typically, the exposure time is not less than eight hours or longer than 168 hours. For UN/DOT testing, the standard time is eight hours.

Test Procedure

1. Preheat water bath if necessary.
2. Preheat test solution to test temperature.
3. Pour desired test concentration, as determined by Step 3 in Test Conditions section, per size of metal strip into standard containers. Put strips in test solution, apply caps. Controls are not exposed to either test solution or water. See Step 2 in Cleaning Metal Strips After Testing—Post-Cleaning Section.
4. At end of test time, remove the metal strips from the container and rinse with distilled water.

Cleaning Metal Strips After Test—Post-cleaning

1. The metal strips are chemically cleaned to remove the corroded metal from the surface by dissolution in an appropriate chemical solution. See Table 1 attached to determine time, temperature, and solution to use. After the metal strips are exposed to the appropriate chemical solution, rinse them with distilled water, followed by an acetone rinse. Let it air dry. Analytically weigh the metal strips (post-cleaning weight).
2. At the same time the test strips are post-cleaned, the controls are also post-cleaned in the appropriate chemical solution per metal type. An ideal procedure should remove only corroded metal, not base metal. To determine the mass loss of the base metal, the controls are post-cleaned. Analytically weigh controls. This weight loss by the control strips is the cleaning weight loss (CWL).

Calculations

The total weight loss (TWL) for each test strip is calculated by subtracting the post-cleaning weight of the strip from the precleaning weight of the strip.

TWL=Pre-cleaning weight—Post-cleaning weight

The cleaning weight loss (CWL) experienced by the control strips per metal type tested is calculated by subtracting the post-cleaning weight of the controls from the pre-cleaning weight of the controls.

CWL=Pre-cleaning weight of controls—Post-cleaning weight of controls

The adjusted weight loss (AWL) is calculated by subtracting the cleaning weight loss from the total weight loss.

AWL=TWL−CWL

The corrosion rate in mils per year (mpy) for each strip is calculated as:

mpy=(534,000*AWL)/(A*T*D)

wherein A=area of the entire strip in square inches (calculating for all 6 sides of the strip, the two major faces and the four edge faces)

T=Time exposure (hours)

D=Metal density (gl/$^{cm}$)

AWL=Adjusted weight loss (grams)

The average corrosion rate was calculated for each set of metal strips. A product causing a corrosion rate larger than 250 mpy is considered corrosive to that specific metal by DOT and the UN.

The friction properties were measured on a slider in the following manner. Samples for lubricity were diluted to 0.1 weight percent active compound (e.g., the amine) with distilled water containing 200 ppm $NaHCO_3$ and streamed along the perimeter of a polished stainless steel plate measuring 20.5 cm in diameter. The plate was connected to an electric motor and rotated at a steady speed when the motor had been turned on. A glass dish weighing 189 grams or a mild steel disk weighing 228 grams was attached to a load cell and placed on the plate in the area wetted by the lubricant solution. When the electric motor was activated, the disk glided freely on the plate. The drag force between the glass or mild steel was detected by the load cell and transferred to a chart recorder.

To assure consistency of the test method, the drag from a standard fatty acid lubricant solution was measured before and after each test run, and the value obtained therefrom arbitrarily assigned a coefficient of friction of 1.00 as a relative standard for the test. Each trail run was referenced to the fatty acid lubricant trials. The results were therefore reported as a relative coefficient of friction (COF). The lower the COF, the better the lubricity. The fatty acid lubricant control comprised by weight 54.7 soft water, 2.0 hydrotrope, 1.6 sodium xylene sulfonate, 10.2 tetrasodium EDTA liquid, 13.5 (85% solution) triethanolamine, 8.9 non-ionic surfactant, and 10.0 fatty acid.

What we claim is:

1. An antimicrobial conveyor lubricant comprising:

(a) alkyl alkoxylated phosphate ester;

(b) secondary alcohol alkoxylate having the formula:

$$R^4—O(R^3O)_n—H$$

wherein $R^3$ comprises an alkyl group containing 1 to 20 carbon atoms, $R^4$ comprises a secondary alcohol group, and n is 3 to 40;

(c) alkyl quaternary ammonium antimicrobial agent; and (d) water;

wherein the ratio of phosphate ester to quaternary ammonium antimicrobial agent is at least 1.5:1.

2. The lubricant of claim 1 wherein the total weight of said alkoxylated phosphate ester and said secondary alcohol alkoxylate are present in a weight to weight ratio of 1.5:1 to 10.0:1 with respect to the quaternary ammonium antimicrobial agent.

3. The lubricant of claim 1 wherein the total weight of said alkoylated phosphate ester and said secondary alcohol alkoxylate are present in a weight to weight ratio of 2.0:1 to 10.0:1 with respect to quaternary ammonium antimicrobial agent, which is a linear quaternary ammonium antimicrobial agent.

4. The lubricant of claim 1 wherein sodium hydroxide is present in said lubricant.

5. The lubricant of claim 1 wherein a chelating agent for divalent cations is present in said lubricant.

6. The lubricant of claim 5 wherein said chelating agent comprises an amine acetic acid.

7. The lubricant of claim 1 wherein said secondary alcohol alkoxylate and an aryl phosphate ester assist in control of viscosity.

8. The lubricant of claim 7 wherein the aryl phosphate ester comprises a phenol ester wherein said phenol group is not substituted with alkyl groups.

9. The lubricant of claim 8 wherein the pH of the lubricant is between 4.5 and 8.0 and the viscosity control component is present in a weight to weight ratio of 2:1 to 1:5 with respect to the quaternary ammonium antimicrobial agent.

10. The lubricant of claim 1 further comprising water, $C_{10-12}$ alkyl ethoxylated phosphate ester, ethylenediamine-tetraacetic acid, alkalating agent, didecyl dimethyl ammonium chloride, $C_{12-15}$ linear alcohol ethoxylate, and a secondary alcohol ethoxylate.

11. The lubricant of claim 1 wherein the lubricant comprises less than 1.5% by weight of triethanol amine.

12. The lubricant of claim 1 wherein said lubricant comprises from 0.1 to 1% by weight of propylene glycol.

13. The lubricant of claim 11 wherein said lubricant comprises from 0.1 to 1% by weight of propylene glycol.

14. The lubricant of claim 1, wherein $R^2$ comprises an alkyl group containing 1 to 4 carbon atoms.

15. The lubricant of claim 1, wherein $R^4$ comprises a secondary alcohol group containing 2 to 8 carbon atoms.

16. A process for lubricating a conveyor used to transport containers, said process comprising applying a composition to the conveying surface of a conveyor, said composition comprising:

(a) alkyl alkoxylated phosphate ester;

(b) secondary alcohol alkoxylate having the formula:

$$R^4—O(R^3O)_n—H$$

wherein $R^3$ comprises an alkyl group containing 1 to 20 carbon atoms, $R^4$ comprises a secondary alcohol group, and n is 3 to 40;

(c) alkyl quaternary ammonium antimicrobial agent; and (d) water;

wherein the ratio of phosphate ester to quaternary animonium antimicrobial agent is at least 1.5:1.

17. The process of claim 16 wherein the total weight of said alkoxylated phosphate ester and said a secondary alcohol alkoxylate are present in a weight to weight ratio of 1.5:1 to 10.0:1 with respect to the quaternary ammonium antimicrobial agent.

18. The process of claim 16 wherein the total weight of said alkoxylated phosphate ester and said secondary alcohol alkoxylate are present in a weight to weight ratio of 2.0:1 to 10.0:1 with respect to quaternary ammonium antimicrobial agent, which is a linear quaternary ammonium antimicrobial agent.

19. The process of claim 16 wherein sodium hydroxide is present in said lubricant.

20. The process of claim 16 wherein a chelating agent for divalent cations is present in said lubricant.

21. The process of claim 20 wherein said chelating agent comprises an amine acetic acid.

22. The process of claim 16 wherein said secondary alcohol alkoxylate and at least one aryl phosphate ester comprising a phenol ester assist in control of viscosity, wherein said phenol group is not substituted with alkyl groups.

23. The process of claim 22 wherein the pH of the lubricant is less than 8.5 and at least one said aryl phosphate ester comprises a phenol ester wherein the phenol is not substituted with alkyl groups.

24. The process of claim 16 wherein the pH of the lubricant is between 4.5 and 8.0.

25. The process of claim 16 wherein said composition further comprises water, $C_{10-12}$ alkyl ethoxylated phosphate ester, ethylene diamine tetraacetic acid or its salts, alkalating agent, didecyl dimethyl ammonium chloride, $C_{12-15}$ linear alcohol ethoxylate, and a secondary alcohol ethoxylate.

26. The lubricant of claim 1 also comprising a corrosion inhibitor.

27. The lubricant of claim 26 wherein said corrosion inhibitor comprises a triazole.

28. The lubricant of claim 27 wherein said triazole has an aromatic substituent.

29. The lubricant of claim 28 wherein said triazole is selected from the group consisting of benzotriazole and tolyltriazole.

30. The process of claim 16 wherein said composition also comprises a triazole.

31. The process of claim 16 wherein said triazole has an aromatic substituent.

32. The process of claim 28 wherein said triazole is selected from the group consisting of benzotriazole and tolyltriazole.

33. The process of claim 28 wherein application of the composition to a used metallic conveying surface and operation of said conveyor increases the luster of said metallic conveying surface.

34. The process of claim 16 wherein the lubricant comprises less than 1.5% by weight of triethanol amine.

35. The process of claim 16 wherein said lubricant comprises from 0.1 to 1% by weight of propylene glycol.

36. The process of claim 35 wherein said lubricant comprises from 0.1 to 1% by weight of propylene glycol.

37. The process of claim 16, wherein $R^3$ comprises an alkyl group containing 1 to 4 carbon atoms.

38. The process of claim 37, wherein $R^2$ comprises a secondary alcohol group containing 2 to 8 carbon atoms.

39. An antimicrobial conveyor lubricant comprising:

(a) alkyl alkoxylated phosphate ester;

(b) secondary alcohol alkoxylate;

(c) alkyl quaternary ammonium antimicrobial agent;

(d) water; and (e) a corrosion inhibitor comprising a triazole;

wherein the ratio of phosphate ester to quaternary ammonium antimicrobial agent is at least 1.5:1.

40. A process for lubricating a conveyor used to transport containers, said process comprising applying a composition to the conveying surface of a conveyor, said composition comprising:

(a) alkyl alkoxylated phosphate ester;

(b) secondary alcohol alkoxylate;

(c) alkyl quaternary ammonium antimicrobial agent;

(d) water; and (e) triazole;

(f) and then moving containers on said conveyor;

wherein the ratio of phosphate ester to quaternary ammonium antimicrobial agent is at least 1.5:1.

41. An antimicrobial conveyor lubricant composition according to claim 1, wherein the ratio of phosphate ester to quaternary ammonium antimicrobial agent is between 2.0:1 to 10.0:1.

42. An antimicrobial conveyor lubricant composition according to claim 1, wherein the ratio of phosphate ester to quaternary ammonium antimicrobial agent is between 2.0:1 to 8.0:1.

43. A method according to claim 16, wherein the ratio of phosphate ester to quaternary ammonium antimicrobial agent is between 2.0:1 to 10.0:1.

44. A method according to claim 16, wherein the ratio of phosphate ester to quaternary ammonium antimicrobial agent is between 2.0:1 to 8.0:1.

* * * * *